US009015869B2

(12) United States Patent
Henderson

(10) Patent No.: US 9,015,869 B2
(45) Date of Patent: Apr. 28, 2015

(54) TOILET LID CLOSURE APPARATUS

(71) Applicant: Jeff Henderson, Seattle, WA (US)

(72) Inventor: Jeff Henderson, Seattle, WA (US)

( * ) Notice: Subject to any disclaimer, the term of this patent is extended or adjusted under 35 U.S.C. 154(b) by 145 days.

(21) Appl. No.: 13/833,511

(22) Filed: Mar. 15, 2013

(65) Prior Publication Data

US 2014/0259341 A1 Sep. 18, 2014

(51) Int. Cl.
*A47K 13/10* (2006.01)

(52) U.S. Cl.
CPC ..... *A47K 13/10* (2013.01)

(58) Field of Classification Search
USPC ..... 4/246.1–246.5, 250, 248
See application file for complete search history.

(56) References Cited

U.S. PATENT DOCUMENTS

| | | | | |
|---|---|---|---|---|
| 622,383 | A | 4/1899 | O'Brien | |
| 2,200,687 | A | 5/1940 | Bercot | |
| 3,316,561 | A | 5/1967 | Newkirk | |
| 3,404,411 | A | 10/1968 | Newkirk | |
| 4,491,989 | A | 1/1985 | McGrail | |
| 4,914,757 | A | 4/1990 | Johnson | |
| 4,951,323 | A | 8/1990 | Shalom | |
| 4,975,988 | A | 12/1990 | Won | |
| 5,060,318 | A | 10/1991 | Jaskiewicz | |
| 5,153,946 | A | 10/1992 | Yoke et al. | |
| 5,349,703 | A * | 9/1994 | Mocilnikar et al. | 4/250 |
| 5,410,766 | A * | 5/1995 | Schumacher | 4/250 |
| 5,430,897 | A | 7/1995 | Lavender | |
| 5,437,063 | A | 8/1995 | Cotham | |
| 5,642,532 | A | 7/1997 | Morant | |
| 5,794,277 | A | 8/1998 | Jones | |
| 5,867,843 | A | 2/1999 | Robello et al. | |
| 6,182,301 | B1 | 2/2001 | Krueger et al. | |
| 6,185,754 | B1 | 2/2001 | Dysle | |
| 6,230,336 | B1 | 5/2001 | Knoll et al. | |
| 6,275,999 | B1 | 8/2001 | Fujita | |
| 6,438,764 | B1 | 8/2002 | Andersen | |
| 6,510,562 | B1 | 1/2003 | Bae et al. | |
| 6,615,412 | B1 | 9/2003 | Hammond | |
| 6,807,687 | B2 | 10/2004 | Marras | |
| 7,150,049 | B1 | 12/2006 | Fitch | |
| 7,398,564 | B2 | 7/2008 | Andersen | |
| 7,913,327 | B2 * | 3/2011 | Meike et al. | 4/246.5 |
| 8,214,932 | B2 | 7/2012 | Shannon | |

* cited by examiner

*Primary Examiner* — Tuan N Nguyen
(74) *Attorney, Agent, or Firm* — Seed IP Law Group PLLC

(57) ABSTRACT

A toilet closure apparatus mounts on a toilet having a base assembly defining a bowl and a bowl ledge, a tank assembly, a toilet lid and a toilet seat. A tank mounting bolt has a tank mounting bolt bore extending axially therethrough. A cable housing is sealedly affixed within the tank mounting bore and disposed to allow a cable to move axially through the tank mounting bore. A hinge assembly includes a frame defining a downwardly extending cable run and an internal cavity including a cylindrical bearing surface having a horizontally extending axis. A hinge member is supported by the bearing surface for rotation about the axis. A hinge pin extends outwardly of the frame, and is fixedly engaged with the toilet seat to effect toilet seat rotation in common with rotation of the hinge member about the axis, the hinge member having at least one camming surface.

25 Claims, 7 Drawing Sheets

TOILET LID CLOSURE APPARATUS

FIELD OF THE INVENTION

The present invention relates to the automatic closure of toilet seats and lids specifically through mechanical unpowered means.

BACKGROUND OF THE INVENTION

There has been a long-felt need for a device which automatically, or semi-automatically, lowers a toilet seat, a toilet lid, or a toilet seat and lid assembly after use. Naturally enough, the toilet has presented a household hazard when users neglect to fully close a toilet lid after use. For example, children and pets have been known to play in the water the toilet bowl contains even to the point of drinking from the toilet bowl or, in the extreme, falling into the toilet bowl. By closing the toilet bowl, users prevent these hazards, by making the bowl less accessible to both children and pets.

The use of a toilet by multiple members of a household also presents some hazards. For example, male users tend to leave the seat and lid assembly in an open position after urination. When open, however, an inattentive and subsequent user might sit on the actual toilet bowl instead of the toilet seat, by acting on an assumption that the toilet is in a seat down lid up position. While never pleasant, in the case of an elderly user, such an episode might cause injury, or at least discomfort in the actual sitting and recovery. Thus, in addition to being more aesthetically pleasing, a consistently closed lid and seat, can prevent the spread of germs, possible injury, and, possibly, embarrassment to members of the household.

The number of alternate means various inventors have proposed of achieving the result of a uniformly closed toilet when not in use has borne witness to the desirability of such consistent practice of toilet lid closure upon completion of use. But, a number of these solutions have, themselves, presented users with contraptions that have been unwieldy, bulky, and visually unacceptable in an activity that is, out of necessity, both private and necessary. Users tend to avoid solutions that intrude too much upon their expectations of a simple and sanitary toilet. Large cylindrical dampers and smaller but extremely complex clockworks that can perform the simple task of closing a toilet lid and seat are available but have never gained much of a market share over the simple hinged toilet seats. Whether true or not, these large installation toilets are considered as complex and intrusive, and in practice the intrusive and complex nature outweighs any benefit achieved by their presence.

In addition, such devices are difficult to install, complex in design, and therefore often expensive. For example, devices employing sensors of various types and electric switches to close the lid and seat are believed to be considerably complex and costly. The more complex, the more perceived opportunities to foster the growth of bacteria and molds in nooks and crannies defined by the complexity of the devices. For these reasons, even if unearned, these devices are tagged with a reputation for being unclean.

Finally, toilets are one province wherein thrifty homeowners have felt confident enough to repair and even upgrade the conventional toilet. For example, Fluidmaster™, a maker and supplier of higher end internal mechanical parts for toilets has about $150 million in annual sales and 350 employees located in San Juan Capistrano in California according to a 2011 issue of Orange County Business Journal. Do-It-Yourselfers ("DIYers") take pride and are willing to spend money on the toilet care products Fluidmaster™ sells annually including more toilet tank replacement valves than any other manufacturer in the world. But the success of Fluidmaster™ has been due to the extremely simple nature of the hardware they have sold and the simple installation of a superior product which affords DIYers a feeling of success beyond that obtained in a simple repair. Perceived as an upgrade, the installation of Fluidmaster™ parts has, for fifty years, been driven by the DIY market.

For that reason, however, nearly every of the solutions proposed by inventors has required breaking into toilet's supply line or tank requiring additional professional plumbing work placing such innovations solely in the hands of the manufacturers as complete toilets rather than as DIY upgrades and, in that market, manufacturers are not willing to adopt changes on systems that they do not view as being "broke." Unless flush requirements had been imposed upon the manufacturers, there seemed little movement among manufacturers to adopt water thrifty mechanisms. Likewise, any innovation relating to seat installation will not likely gain market acceptance unless it is either legislated or forced by the DIY market acceptance.

The vast numbers of proposed solutions belie the need for a successful implementation that can be readily adopted by the DIY market. Robert Anderson, in U.S. Pat. No. 7,398,564, dated Jul. 15, 2008 taught a closure apparatus including a mounting bolt having an opening therethrough and a rod disposed within the opening. A spring biases the rod and a lever movable with respect to the mounting bolt. A latch release mechanism causes the latch point of the lever to move with respect to the mounting bolt to close the lid. To accomplish this, however, Anderson teaches an unwieldy lever drawn against the bolt with a substantial lever arm that may be subject to racking within the bolt.

A nonexhaustive list of other such devices include U.S. Pat. No. 6,230,336 which disclosed use of a direct mechanical connection to the toilet's flush arm as the actuating means. However, this direct mechanical connection is relied upon only to, through use of a line or cord, activate an electrical switch in an obtrusive electro-mechanical device atop the toilet bowl's ledge that suffers from the complexity decried above. Another device as set forth in U.S. Pat. Nos. 6,230,336 and 6,185,754 discloses use of the mounting opening as a water conduit to an obtrusive mechanism mounted atop the toilet bowl's ledge which, in practice is subject to leaking and requires extensive modification of the workings. U.S. Pat. No. 5,867,843 discloses use of the mounting opening for an air tube to an obtrusive mechanism mounted atop the toilet bowl's ledge. U.S. Pat. Nos. 5,410,766 and 4,951,323 disclose use of the mounting opening as a pathway for a flexible cable to raise, rather than automatically lower, a seat or lid; while U.S. Pat. No. 4,975,988 discloses use of the mounting opening as a pathway for a flexible cable connected to a foot pedal to lower as well as raise the seat.

In none of the above nor anywhere in the art, has a tank mounting bolt having an axial bore been sealed to a housing of a cable so as to provide a nonleaking passage for a housed cable to pass from the inside of the toilet tank to a latch at the seat and lid hinge to allow the seat and lid to close in response to axial movement of the cable within the housing. There exists, therefore, within the art, an unmet need for an automatic lid and seat closer based upon such a tank mounting bolt and cable housing.

SUMMARY OF THE INVENTION

A toilet closure apparatus mounts on a toilet having a base assembly defining a bowl and a bowl ledge, a tank assembly, a toilet lid and a toilet seat. A tank mounting bolt has a tank mounting bolt bore extending axially therethrough. A cable housing is sealedly affixed within the tank mounting bore and disposed to allow a cable to move axially through the tank mounting bore. A hinge assembly includes a frame defining a downwardly extending cable run and an internal cavity including a cylindrical bearing surface having a horizontally extending axis. A hinge member is supported by the bearing surface for rotation about the axis. A hinge pin extends outwardly of the frame, and is fixedly engaged with the toilet seat to effect toilet seat rotation in common with rotation of the hinge member about the axis, the hinge member having at least one camming surface.

Embodiments of the invention include at least one pawl. Each pawl is configured to engage each of the at least one camming surface corresponding to the pawl, such that when in a first pawl position, each pawl will detain the hinge member in the open position and when in a second pawl position will allow the hinge member to rotate through the range of motion to a closed position. A bellcrank is mechanically connected to the at least one pawl such that in movement from a first bellcrank position to a second bellcrank position. The bellcrank draws the at least one pawl from the first pawl position to the second pawl position.

The cable extends from the bellcrank through the cable run such that drawing the cable through the cable housing moves the bellcrank from the first bellcrank position to the second bellcrank position, thereby allowing the hinge member to rotate from the open position to the closed position. Once the at least one pawl is drawn into the second position, the lid will fall under the influence of gravity to a closed position in response to activating the flush lever.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
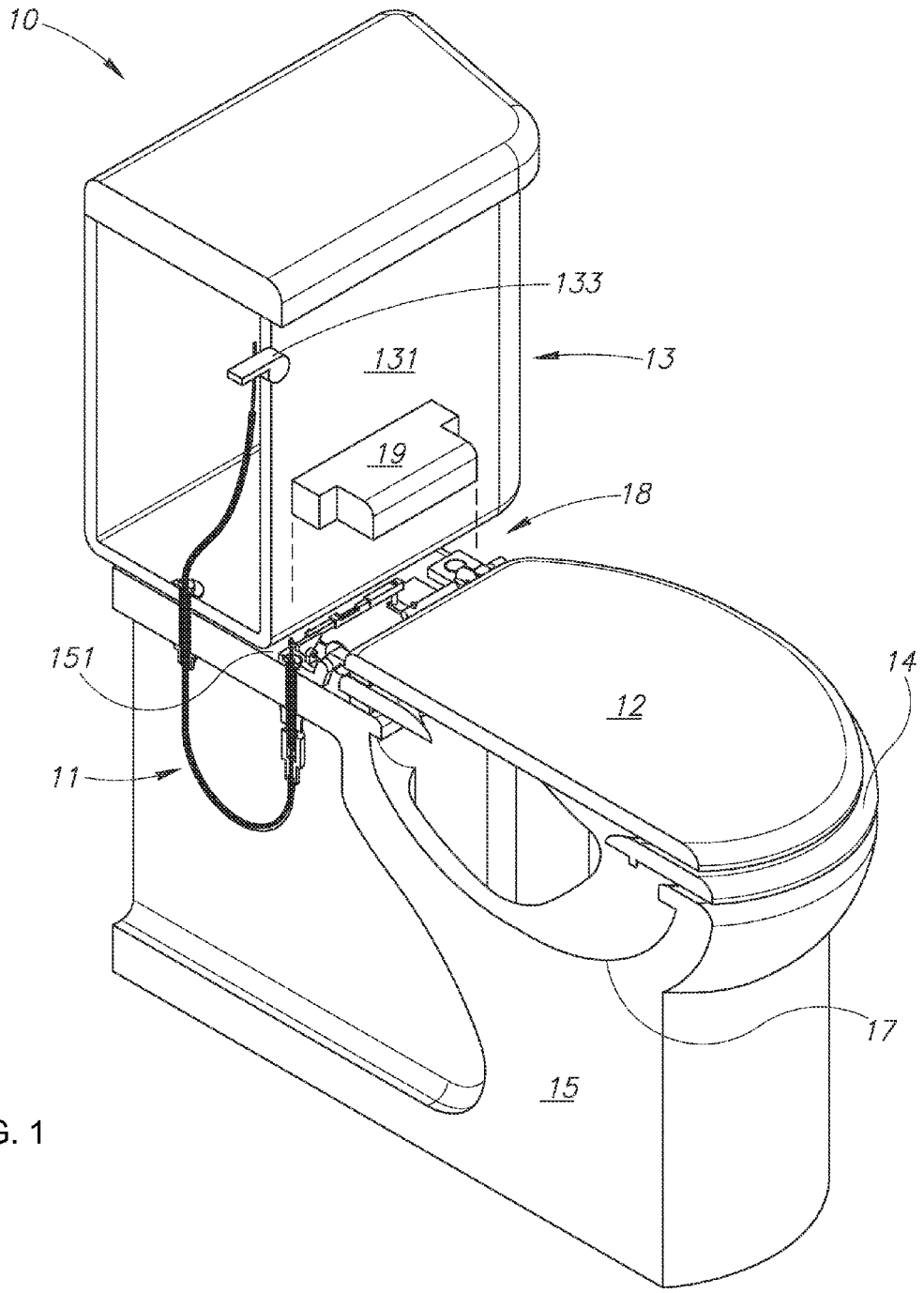
FIG. 1 is a perspective view of a conventional toilet including a cutaway to depict one embodiment of the inventive toilet closure device.

FIG. 1 is a perspective view of a conventional toilet 10 including a cutaway to depict one embodiment of the inventive toilet closure device. An overview of the toilet 10 provides a roadmap to understand the instant invention. A toilet 10 includes two principle subassemblies: a tank assembly 13 and a base assembly 15 defining a bowl 17 and a bowl ledge 151. The bowl ledge 151 provides an upper surface for landing a hinge assembly 18 having a hinge assembly cover 19 to cover principal working of the hinge assembly. A cable assembly 11 mechanically links a mechanism within the tank assembly 13 to the hinge assembly 18 and effects the release of the hinge assembly to allow the toilet lid 12 and seat 14 to fall to their closed position in response to mechanical action within the tank assembly 13 drawing a cable through the housing assembly 11. A flush lever 133 is shown as located on a front face of the tank 131; as the flush lever 133 is used to initiate the flushing sequence that culminates in the closing of the toilet lid 12 and seat 14. The hinge assembly 18 is covered by a hinge assembly cover 19.

Figure 2A:
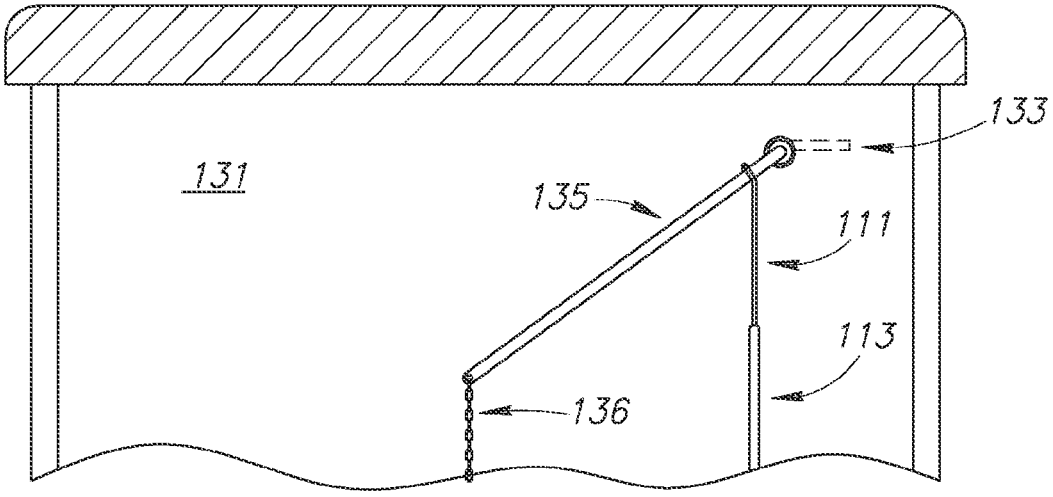
FIG. 2A depicts a flush lever and flush lever arm in a rest position showing the inventive cable attached to flush lever arm.
Figure 2B:
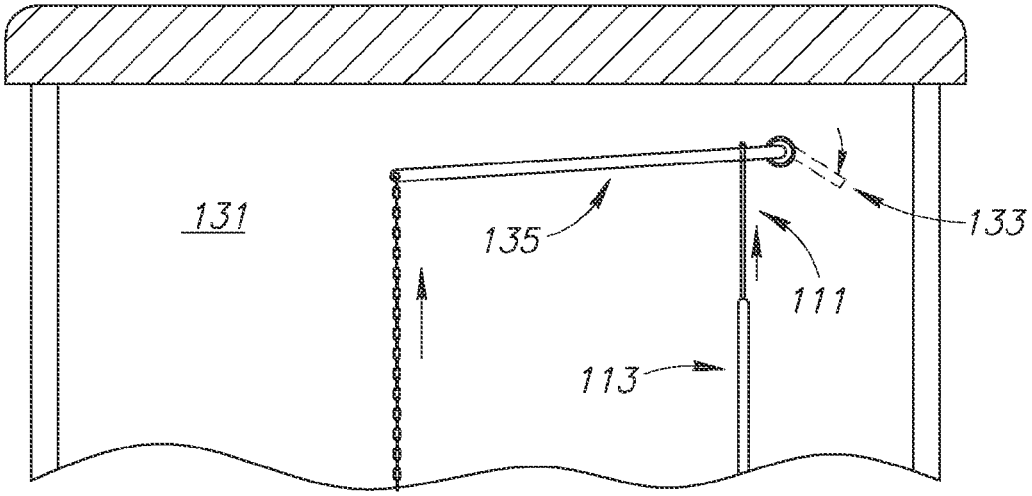
FIG. 2B depicts the flush lever arm in a flush position showing the inventive cable attached to flush lever arm.

FIG. 2A depicts a flush lever 133 in a rest position showing the inventive cable 111 attached to flush lever arm 135 and FIG. 2B depicts the flush lever 133 in a flush position. Importantly, in the first preferred embodiment, the flush lever arm 135 as it progresses from the rest position to the flush position the flush lever arm 135 draws a cable 111 axially from a cable housing 113. The axial movement of the cable 111 within the cable housing 113 is the principal movement that enables timing of operation of the hinge assembly 18.

Figure 3A:
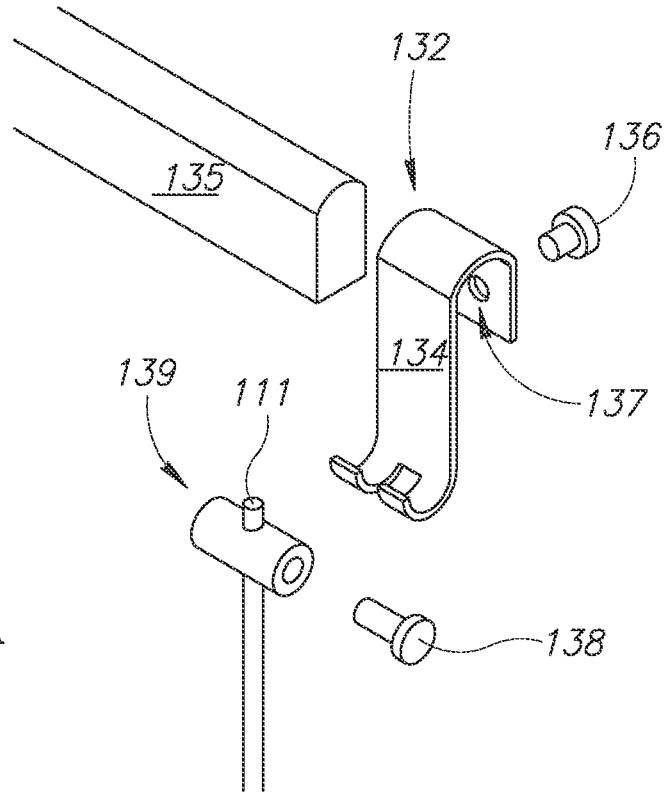
FIG. 3A depicts an exploded view of a cable attachment hook configured to draw the cable axially through the cable housing.
Figure 3B:
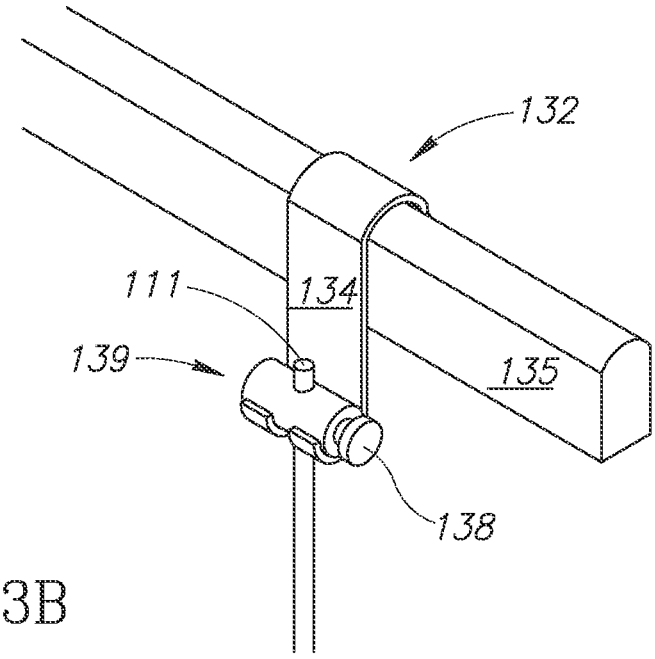
FIG. 3B depicts a perspective view of the cable attachment hook configured to draw the cable axially through the cable housing.

In a presently preferred embodiment, a cable attachment hook assembly 132 includes a cable attachment hook 134 for connecting the cable 111 to the flush lever arm 135 is depicted in FIG. 3A in exploded view and in FIG. 3B a perspective view of the hook. While connection between the cable 111 can be accomplished within the spirit of the invention by any of a number of conventional means, such as a swivel, a shackle, a stirrup fastened to the flush lever arm 135 with a pin or even a swaged end. Nonetheless, the presently preferred embodiment includes the cable attachment hook 134 as it allows the DIYer to attach the cable 111 to an otherwise unprepared flush lever arm 135.

The cable attachment hook 134 is generally S-shaped in profile to enable it to engage the flush lever arm 135 on opposite sides. Affixation is achieved by rotation of a set screw 136 within a threaded hole 137 to mechanically engage the flush lever arm 135 fixing a radius between the rotational axis of both the flush lever 133 and the flush lever arm 135 and an attachment point to hold the cable 111. By keeping the radius constant, the cable hook assembly 134 causes the flush lever arm 135 to draw a predictable and repeatable length of the cable 111 axially through the cable housing 113 on each full range deflection of the flush lever 133. The cable hook assembly 134 engages the cable 111 by means of a cylindrical cable stop 139 cooperating with a cable stop screw 138. The cable stop 139 and cable stop screw 138 fixedly engages the cable 111 and provides an orthogonally disposed rod to rest in tines formed in the cable hook 134. Because the tines engage the cable stop 139 while still allowing the cable stop 139 to rotate within the tines to orient the cable stop 139 to most efficiently draw the cable even should the orientation change throughout the movement of flush lever arm 135. Once again, other connection means will serve the ends of the invention, however, the cable hook assembly 134 is the presently preferred embodiment.

Figure 4:
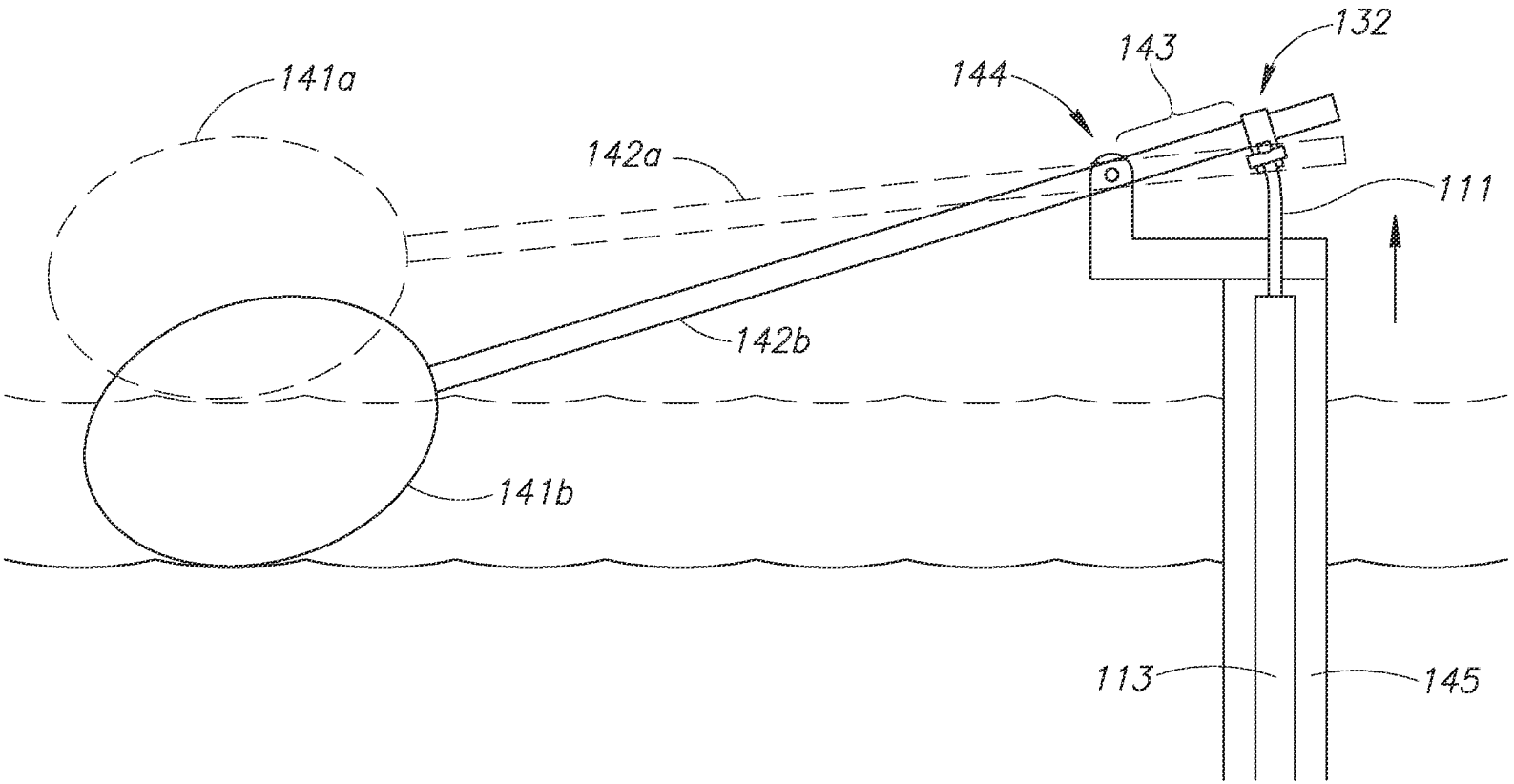
FIG. 4 depicts in orthogonal view a float lever in a second position and the float lever in a first position shown in phantom.

To achieve the same axial movement of the cable 111 through the cable housing 113, a second presently preferred embodiment as shown in FIG. 4 exploits a float 141*a, b* on a float arm 142 *a, b* to draw the cable 111 from the cable housing 113. As opposed to the first embodiment, there are both advantages and disadvantages to this second embodiment. Among the advantages is the lack of tactile feedback through the flush lever 133 betraying the mechanical connection between the flush lever arm 135 and the hinge assembly 18. Nonetheless, the presence of the cable 111 on the flush lever arm 135, if improperly placed, might impede the functional operation of the float 141 *a, b*. Nonetheless, this second embodiment allows installation in any tank in that it is based upon the presence of water, even if the flushing is achieved by unconventional flush triggering means such as a flush button rather than a flush lever 133. By triggering on a water level within a tank, the cable 111 is not mechanically connected to the flush lever 133 in any fashion but rather simply triggers based upon the flushing event which empties the tank. In some conventional toilets a float mechanism resides as part of the flushing capability of the toilet. The float embodiment may either exploit the existing float or may comprise a second, independent float to draw the cable 111 through the housing 113.

FIG. 4 depicts in orthogonal view a float lever in a second position and the float lever in a first position shown in phantom. As is apparent in FIG. 4, as the water level in the tank, and correspondingly as the tank float 141*a* and float arm 142*a* (shown in phantom in the full tank position or rest position) drops to a lower level (float 141*b* and float arm 142*b*) correspondingly moves a float lever arm 143 to draw the cable 111 axially out of the housing 113 just as the first embodiment likewise draws the cable 111 out of the housing 113. Because of the leverage the lever arm 143 affords, the weight of the float need not be great in order to draw the cable 111 axially from the cable housing 113. As such, buoyancy of the float 141 *a, b* need not be significantly adversely affected to provide sufficient torque about a float pivot 144 on a float tower 145 in order draw the cable 111 axially out of the housing 113.

Other embodiments are also possible. One of the simplest is not illustrate but is easy to understand. Consider, for example a distinct button on a lid of a toilet tank assembly 13. Configured to draw the cable 111 axially from the cable housing 113 upon depression, such a button could easily operate the hinge assembly in the same manner as is described in either of the first two preferred embodiments. As such, the invention is not limited to either a flush lever arm 135 embodiment nor a float lever arm 143 embodiment but rather can be practiced with any practical means of drawing the cable axially from the cable housing 113. Indeed, a bicycle brake lever could perform the task and the inventor envisions the use of a tool comprising such a lever for diagnostic troubleshooting of the inventive automatic toilet lid closure apparatus, the tool being useful for isolating linkage problems as might exist in an installation by independently operating the hinge assembly without requiring the use of either of the first or second preferred embodiments to do so. Axial movement of the cable 111 within the cable housing 113 however effected is sufficient to practice the essence of the invention and to do so is not limited to the specific manner in which the movement is effected.

Figure 5:
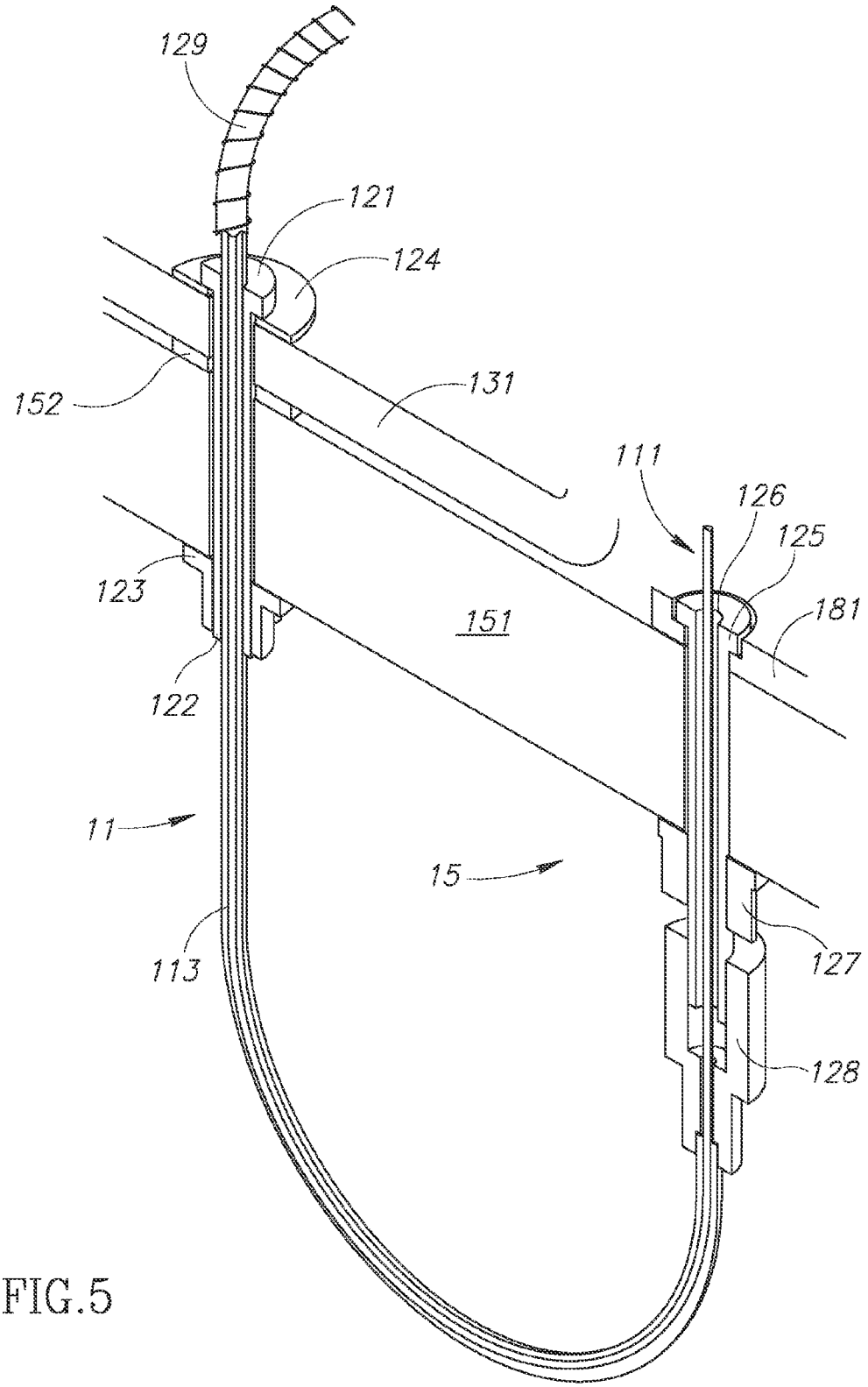
FIG. 5 shows an inventive cable assembly in cutaway perspective view.

Naturally, then, the cable assembly 11 stands at the heart of the invention. FIG. 5 shows the inventive cable assembly 11 in cutaway perspective view in order to demonstrate its features in the automatic toilet lid closure device on a toilet 10. The affects of relative axial movement between the cable 111 and the cable housing 113 have been discussed above and cannot be overstated, but without the ability to traverse between the water-filled environment of the tank assembly 13 to the necessarily dry environs outside of the tank assembly 13 the cable would be of little use.

A two piece toilet 10 (FIG. 1) has a set of bolts 121 that secure the tank 131 to the base 15 at a base ledge 151. These bolts 121 go through a hole the tank 131 defines located at the bottom of the tank 131 and through matching holes in the bowl ledge 151. Typically rubber washers 124 fit between the bolt 121 head and the inside of the tank 131. A gasket 152 fits between the tank 131 and the bowl ledge 151 and finally a rubber, plastic or metal washer (not shown for clarity of illustration as it is optional but mentioned here as it is known in the art) fits onto the bolt 121 between the bowl ledge 151 and the nut 123 that secures it in place.

The bolt 121 is distinct from those known in the art. The bolt 121 defines a bolt bore 122 axially through the bolt 121. Within the defined bore 122 the cable housing 113 is sealingly bedded into the bore 122 thus, with the bolt 121 providing an integral unit such that proper installation of the toilet bowl bolt 121 effects proper placement of the cable housing 113 at the interface between the water within the tank 131 and the dry environs surrounding the toilet 10. For this reason, the cable housing will either be sealed at its upper end within the tank or will merely extend beyond and above the upper surface of the water within the tank 131 such that the housing 113 itself does not become a syphon to empty the tank.

Advantageously, neither plumbers nor most DIYers will need distinct instructions as to installation or to troubleshooting the bolt 121 with the cable housing 113 potted within it because the bolt 121 acts just as a conventional toilet tank bolt would. It is the intent of the inventor that the bedding or potting of the cable housing 113 within the bore 121 is so completely watertight, that the introduction of the inventive bolt 121 to the toilet 10 will not add a new failure mode to the resulting toilet 10. This is a reasonable expectation as the bolt 121 supports the cable housing 113 throughout the length of the bore 122 thereby eliminating undue flexure of the housing 113. Thus, any bedding sealant used will not be unduly stressed after curing. With a suitably selected sealant and housing 113, the use of the bolt 121 and potted cable housing 113 will not adversely affect the life span of the toilet 10.

In one embodiment, a toilet hinge bolt 125 is inserted into a frame 181 of the hinge assembly 18 to hold the frame 181 in engagement with the bowl ledge 151 providing registry and secure footing for the hinge assembly 18 and is then secured by a hinge nut 127. In some other embodiments of the invention, the toilet hinge bolt 125 is not a distinct structure but may be an integral part of the frame 181. Nonetheless, in either embodiment, a lower stud portion will exist and is inserted into holes the bowl ledge 151 defines a hinge bolt bore 126 similar to that the toilet bowl bolt 121 defines. (For convenience of illustration, the application will continue to refer to the toilet hinge bolt 125 as though it were a distinct structure though the invention is practiced in either embodiment.) The toilet hinge bolt 125 cooperates with the toilet hinge nut 127 or the stud extension of the frame 181 to hold the frame 181 in place. In a conventional manner the toilet hinge nut 127 is threaded onto the toilet hinge bolt 125 and tightening conventionally. The barrel adjuster 128 is then threaded onto the toilet hinge bolt 125 to a state of being "hand tight".

As stated above, either of the toilet hinge bolt 125 (or the stud extension) defines the toilet hinge bolt bore 126 just as if the toilet hinge bolt 125 had been a distinct and separable structure. Once the cable housing 113 and toilet bowl bolt 121 have been suitably installed by sufficient and appropriate tightening of the toilet bowl nut 123 and toilet hinge nut 127 respectively, the DIYer will insert the cable housing 113 extending out of the bottom of the toilet bowl bolt 121 into a recess in a barrel adjuster 128 threadedly residing on the toilet hinge bolt 125. (At the toilet hinge bolt 125, there is no need for a watertight engagement between the cable housing 113 and the hinge bolt bore 126.) When fully assembled, the cable 111 extends from the interior of the tank 131, through cable housing 113 as it, in turn, extends through the toilet bowl bolt 121 out of the cable housing 113 and through barrel adjuster 128 and into the toilet hinge bolt bore 126 on to connect to the hinge assembly 18.

Within the hinge assembly 18, the cable 111 extends through bellcrank (not shown) and as well through the frame 181 and hinge bolt 125 into the housing 113 and through the housing 113 axially and thus through the toilet bowl bolt 121 and into the interior of the tank 131. Once the cable is connected within the tank 131, the barrel adjuster 128 is rotated to lengthen and shorten the path of the cable to assure proper operation of the hinge assembly 18 in response to axial movement of the cable within the housing 113. This sort of adjustment is known in conventional art in the context of use of barrel adjusters to adjust cable brakes or shifters on bicycles.

Also shown in FIG. 5 is a bendable sleeve 129. In a preferred embodiment, the sleeve has a smooth sleeve made of any of the thermoplastics known as PE, PVC, PA, PP, or of HDPE sized to slidingly enclose the cable housing 113. The sleeve is, in the nonlimiting preferred embodiment, overwrapped with jacketed metallic wire to allow the resulting bendable sleeve to be bent into distinct shapes thereby providing the housing with the ability to snake around mechanical pieces within the tank 131 without interfering with their operation. The sleeve is not necessary for the operation of the invention but is provided in a preferred embodiment of the invention to assure appropriate support for the cable housing in even the most tightly configured tank 131 environs.

Figure 6:
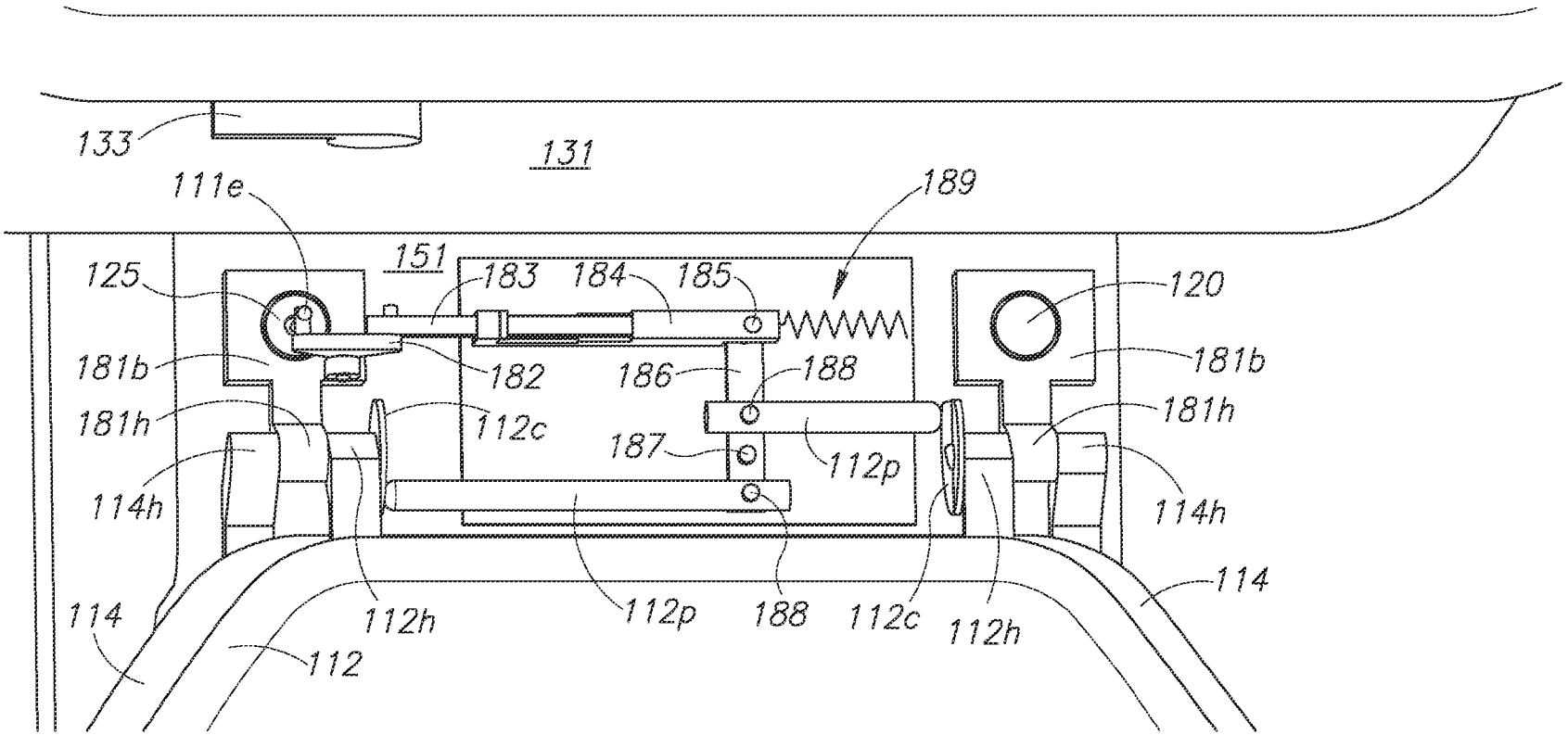
FIG. 6 shows an off-axis perspective view of a hinge assembly.

Moving on to the operation of the hinge assembly 18 when suitably affixed to the bowl ledge 151, FIG. 6 shows an off-axis perspective view of a hinge assembly 18. To the left of FIG. 6 the cable 111 emerges from the toilet hinge bolt 125 to pass through an arm on the bellcrank 182 to then terminate in a means to fixedly engage the cable 111*a* swaged end 111*e* in a nonlimiting embodiment. A knob is permanently affixed to the end of the cable 111 by a method known as swaging, a forging process in which the dimensions of the knob are compressed using a die or dies to assure a permanent fixture of the knob allowing it to impart an axial tension on the cable 111 without parting. Thus, axial movement of the cable 111 imparts a rotational movement of the bellcrank 182.

A bellcrank 182 is a type of crank that changes motion through an angle. The angle can be any angle from 0 to 360 degrees, although 90 degrees and 180 degrees are common. The name comes from its first use, changing the vertical pull on a rope to a horizontal pull on the striker of a bell, used for calling staff in large houses or commercial establishments. In the preferred embodiment, the bellcrank 182 is of a typical 90 degree bellcrank 182 configuration and consists of an "L" shaped crank pivoted where the two arms of the L meet. As explained above, the cable 111 is attached to one of the two arms of the bellcrank 182. A moving rod 183 is attached to the end of the other L arm. When the cable 111 is pulled to move axially into the toilet hinge bolt bore 126, the L rotates around the pivot point, pulling on the other arm, thereby moving the rod 183.

Changing the length of the arms changes the mechanical advantage of the system. Selection of suitably lengths is an engineering issue and not treated here. There is a tradeoff between range of motion, linearity of motion, and size. The greater the angle traversed by the crank, the more non-linear the motion becomes (the more the motion ratio changes). In this nonlimiting embodiment, the lengths are selected to impart a relatively short linear movement to the rod 183 and therefore issues of nonlinearity are not dominating in the solution of the optimal bellcrank 182.

As is evident, the frame 181 governs the spatial relations of components within the hinge assembly 18 (shown here without the cover 19 to reveal the inner workings.) Hinge bases 181*b* are affixed to the frame 181 and then bolted to the bowl ledge 151 with, alternately, the toilet hinge bolt 125 and the standard bolt 120. These two bolts 120, 125 securely hold the hinge assembly 18 to the bowl ledge 151 and, in conjunction with the frame 181 prevent relative movement between the hinge bases 181*b*, the seat hinges 114*h*, and the lid hinges 112*h* with the attached camming surfaces 112*c* which rotate with the lid hinges 112*h*, at least in the closing direction such that preventing the camming surface 112*c* from rotating prevents the hinge 112*h* likewise preventing the lid 112 from closing whenever the camming surfaces 112*c* are prevented from rotating. Rotation of the seat hinge 114 on an extending hinge pin (not shown) is not prevented in the preferred embodiment. Both of the seat hinge 114*h* and the lid hinge 112*h* ride on the hinge pin. The hinge pin rotates within a circular bearing surface to allow opening and closing of either of the seat 114 and the lid 112.

Returning now to the linear motion of the rod 183 moving in response to axial movement of the cable 111 relative to the housing 113 and the toilet hinge bolt 125. Linear movement of the rod 183 translates the stirrup 184 and its attendant pivot 185 biased by a tensioning spring 189 urging the stirrup 184 in a direction pulling the cable 111 out of the toilet hinge bolt 125 opposing actuating movement into the cable housing 113. A lever arm 186 pivots on a pivot pin 187 rotating in a releasing direction in response to the axial movement of the cable 111 into the toilet hinge bolt 125 rotating the bellcrank 182 as described above.

In one embodiment of the invention, there exist two pawls 112*p* that selectively engage two camming surfaces 112*c* to selectively prevent and allow rotational motion of the lid hinge 112*h*. Nothing requires that there be exactly two pawls 112*p* engaging two camming surfaces 112*c*. Either a single pawl 112*p*/camming surface 112*c* pair or multiple pawl 112*p*/camming surface 112*c* pairs can selectively prevent rotation of the lid hinges 112*h* in practice of the invention. For that reason, within the application the terms at least one pawl will be used to correspond with at least one camming surface do not dictate a specifically limiting structure to only a single configuration. Removing one of the two single pawl 112*p*/camming surface 112*c* pairs will not, for example, impair the normal use of the hinge assembly 18.

As the lever arm 186 rotates, the pawls 112*p* pivotally connected to the lever arm 186 at pins 188 withdraw from engagement with the camming surfaces 112*c* to free the lid hinges 112*h* to rotate relative to the hinge base 181*h*. Additionally, in order to allow for vagaries in the rotation of the lever arm 186, the stirrup 184 is slidingly mounted on the rod 183 to allow relative linear motion of the stirrup 184 on the rod 183 though that movement is limited in order to transfer actuating movement of the bellcrank 182 to the lever arm 186.

Figure 7:
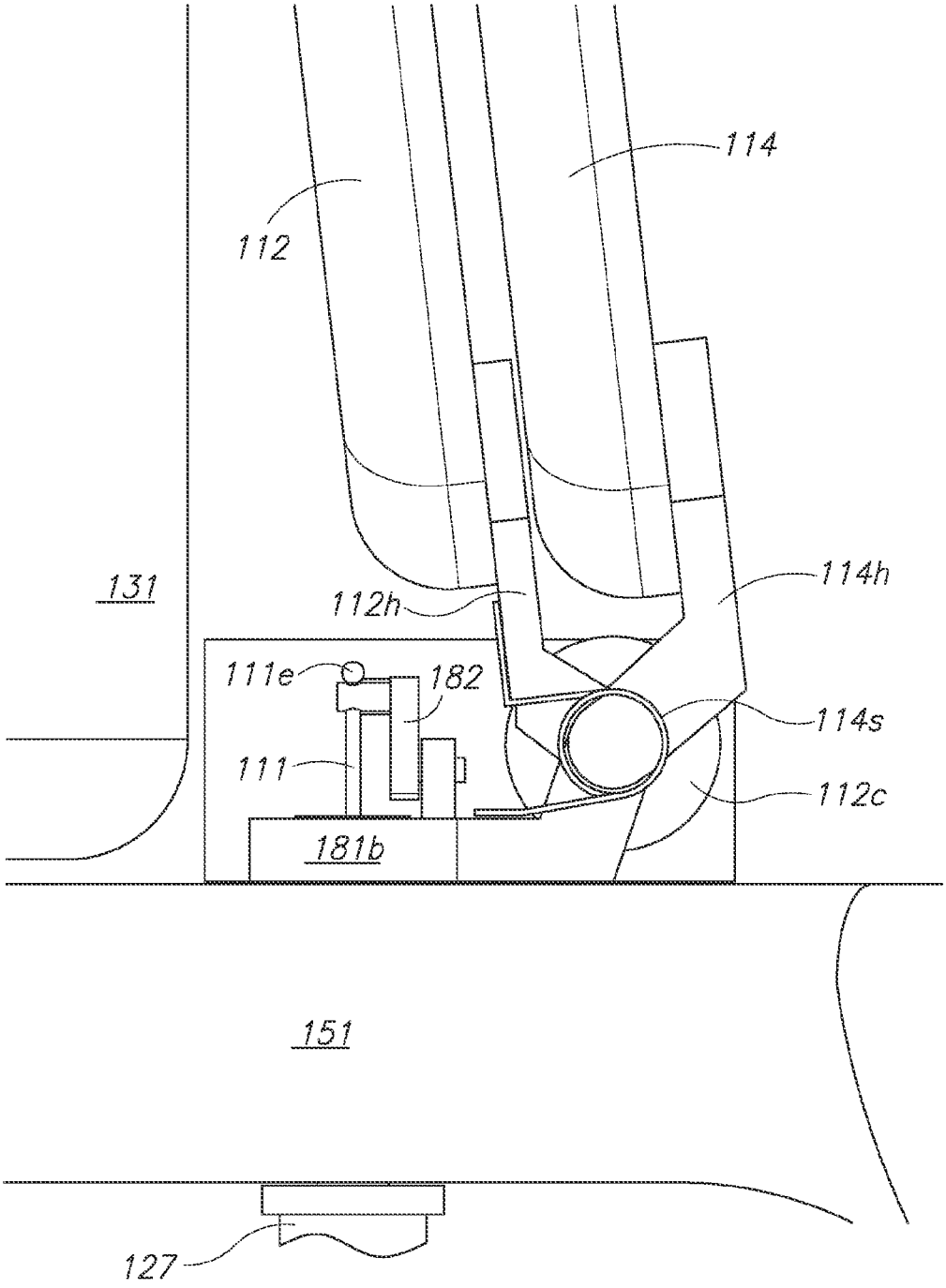
FIG. 7 shows an orthogonal view of the hinge assembly.

Additional optional governing mechanisms are desirable but not required for the operation of the hinge assembly 18 in light of the designed movement of the seat hinges 114*h* and the lid hinges 112*h* relative to the base hinges 181*b*. FIG. 7 shows an orthogonal view of the hinge assembly 18 depicting, at least, a torsional spring 114*s* that serves two purposes. In operation, the torsional spring urges the lid 112 and with it the lid hinge 112*h* into a closed position. Thus, once the at least one pawls 112*p* withdraws from engagement with the corresponding camming surface 112*c* allowing rotation, the torsional spring 114*s* rotates the lid driving the center of gravity horizontally away from the tank 131 past the hinge pin toward a closed position. After passing the hinge, the position of the center of gravity tends to urge the lid into a closed position, at some point overtaking any contribution from the torsion spring 114*s*. At this point, the torsion spring 114*s* actually becomes overly deformed and retards the rotational speed of the lid as it rotates to the closed position. Properly selected for its exerting forces, the torsional spring 114*s* can assure a "soft closure" by the lid even after urging it into a closed positon.

Along with the torsional spring 114*s*, a conventional damper (not shown) can be used to slow rotational movement of the hinges 114*h*, 112*h* relative to the hinge base 181*h* without applying an accelerating force to the lid. These dampers are available in various configurations which will augment the operation of the inventive closure apparatus to assure that closure will not produce jarring noises or undue wear on either the lid or the seat. These are not, by themselves, claimed as a basis for novelty though when used in conjunction with the hinge assembly 18 the resulting configuration when viewed as a whole is novel and useful.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A toilet closure apparatus adapted to mount on a toilet having a base assembly defining a bowl and a bowl ledge, a tank assembly, a toilet lid and a toilet seat, the closure apparatus comprising:

a tank mounting bolt having a tank mounting bolt bore extending axially therethrough;

a cable housing sealedly affixed within the tank mounting bore and disposed to allow a cable to move axially through the tank mounting bore; and a hinge assembly comprising:

a frame engaging an upper surface of the toilet bowl ledge defining a downwardly extending cable run and an internal cavity including a cylindrical bearing surface having a horizontally extending axis, a hinge member supported by the bearing surface for rotation about the axis through a range of motion extending from an open hinge member position to a closed hinge member position and including a hinge pin extending outwardly of the frame, and fixedly engaged with the toilet seat to effect toilet seat rotation in common with rotation of the hinge member about the axis, the hinge member having at least one camming surface;

at least one pawl; each pawl to engage each of the at least one camming surface such that when in a first pawl position, each pawl will detain the hinge member in the open position and when in a second pawl position will allow the hinge member to rotate through the range of motion to a closed position;

a bellcrank mechanically connected to the at least one pawl such that in movement from a first bellcrank position to a second bellcrank position, the bellcrank draws the at least one pawl from the first pawl position to the second pawl positon; and the cable extending from the bellcrank through the cable run such that drawing the cable through the cable housing moves the bellcrank from the first bellcrank position to the second bellcrank position, thereby allowing the hinge member to rotate from the open position to the closed position.

2. The toilet closure apparatus of claim 1, wherein the cable run further comprises a frame mounting bolt having a frame mounting bolt bore extending axially therethrough, the frame mounting bolt bore configured to admit the cable and allow the cable to move axially within and the bottom opening and including an upper end, and a lower stud portion having a lower threaded part and comprising a frame mounting nut adjustably threaded on the threaded lower part of the stud portion to bias the frame mounting nut holding the frame in engagement with the upper surface of the bowl.

3. The toilet closure apparatus of claim 2, wherein the cable run still further comprises a barrel adjuster, the barrel adjuster including a conditionally rotatable adjuster nut in contact with the cable housing and in threaded engagement with the frame mounting bolt for conditionally relatively moving the adjuster nut, such that manual rotation of the adjuster nut under a manual force above a threshold level causing the adjuster nut to traverse the axial length of the frame mounting bolt in response to the manual rotation in either direction thereby extending or shortening the cable run.

4. The toilet closure apparatus of claim 1 wherein the tank mounting bolt includes an upper end, and a lower stud portion having a lower threaded part and includes a tank mounting nut adjustably threaded on the threaded lower part of the stud portion to bias the tank mounting bolt holding the tank assembly in engagement with the upper surface of the bowl.

5. The toilet closure apparatus of claim 4, wherein the cable housing includes a generally cylindrical sleeve that nestingly surrounds along at least a length of the cable housing to resiliently form and thereby to support the cable housing along the length.

6. The toilet closure apparatus of claim 4, wherein the tank assembly includes a flush lever for initiating a flushing of the bowl with water from the tank assembly upon rotation of the flush lever from a rest position to a flush position, and wherein rotating the flush lever to the flush position draws the cable through the housing moving the bellcrank from the first bellcrank position to the second bell crank position thereby moving the at least one pawl from the first pawl position to the second pawl position thereby to close one of the group consisting of the seat and the lid.

7. The toilet closure apparatus of claim 4, wherein the tank assembly includes a float arm such that when water within the tank assembly drops below a level corresponding to a volume sufficient for flushing the bowl, the float arm drops to draw the cable through the housing moving the at least one pawl from the first pawl position to the second pawl position thereby to close the one of a group consisting of the toilet seat and the toilet lid.

8. The toilet closure apparatus of claim 1, wherein the at least one pawl includes a spring configured to bias the at least one pawl urging it into the first pawl position.

9. The toilet closure apparatus of claim 1, further comprising a torsion spring assembly connected between the frame and the hinge member urging the hinge member to a position between the open hinge member position and the closed hinge member position such that upon the movement of the at least one pawl from the first pawl position to the second pawl position, the torsion spring assembly urges movement of the hinge member past a gravitational equilibrium position such that gravity further urges the hinge member toward the closed hinge member position.

10. The toilet closure apparatus of claim 9, wherein the torsion spring assembly further comprises a damper connected between the frame and hinge member for exerting a dampening torque upon the hinge member during at least one direction of rotation of the hinge member relative to the frame.

11. A cable assembly for a toilet closure apparatus adapted to mount on a toilet having a base assembly defining a bowl and a bowl ledge, a toilet lid and a toilet seat, the cable assembly comprising:

a tank mounting bolt having a tank mounting bolt bore extending axially therethrough;

a cable housing sealedly affixed within the tank mounting bore and disposed to allow a cable to move axially through the tank mounting bore, the cable having an end adapted for connection to a hinge assembly such that, axial movement of the cable causes the hinge assembly to rotate, rotation of the hinge assembly rotatably moving at least one of the toilet lid and the toilet seat from an open position to a closed position.

12. The cable assembly of claim 11, wherein the hinge assembly comprises a frame, engaging an upper surface of the toilet bowl ledge, defining a downwardly extending cable run, the cable run further comprising a frame mounting bolt having a frame mounting bolt bore extending axially therethrough, the frame mounting bolt bore configured to admit the cable and allow the cable to move axially within and the bottom opening and including an upper end, and a lower stud portion having a lower threaded part and comprising a frame mounting nut adjustably threaded on the threaded lower part of the stud portion to bias the frame mounting nut holding the frame in engagement with the upper surface of the bowl.

13. The cable assembly of claim 12, wherein the cable run still further comprises a barrel adjuster, the barrel adjuster including a conditionally rotatable adjuster nut in contact with the cable housing and in threaded engagement with the frame mounting bolt for conditionally relatively moving the adjuster nut, such that manual rotation of the adjuster nut under a manual force above a threshold level causing the adjuster nut to traverse the axial length of the frame mounting bolt in response to the manual rotation in either direction thereby extending or shortening the cable run.

14. The cable assembly of claim 11 wherein the cable assembly is adapted to mount to a tank assembly and the tank mounting bolt includes an upper end, and a lower stud portion having a lower threaded part and includes a tank mounting nut adjustably threaded on the threaded lower part of the stud portion to bias the tank mounting bolt holding the tank assembly in engagement with the upper surface of the bowl.

15. The cable assembly of claim 14, wherein the cable housing includes a generally cylindrical sleeve that nestingly surrounds along at least a length of the cable housing to resiliently form and thereby to support the cable housing along the length.

16. The cable assembly of claim 14, wherein the tank assembly includes a flush lever for initiating a flushing of the bowl with water from the tank assembly upon rotation of the flush lever from a rest position to a flush position, and wherein rotating the flush lever to the flush position draws the cable through the housing moving at least one pawl from the first pawl position to the second pawl position thereby to close the one of a group consisting of the seat and the lid.

17. The cable assembly of claim 14, wherein the tank assembly includes a float arm such that when water within the tank assembly drops below a level corresponding to a volume sufficient for flushing the bowl, the float arm drops to draw the cable through the housing moving the at least one pawl from the first pawl position to the second pawl position thereby to close one of a group consisting of the toilet seat and the toilet lid.

18. A method of automatically closing a toilet lid, the method comprising:

drawing a cable axially through a cable assembly for a toilet closure apparatus adapted to mount on a toilet having a base assembly defining a bowl and a bowl ledge, a tank assembly, a toilet lid and a toilet seat, the cable assembly comprising:

a tank mounting bolt having a tank mounting bolt bore extending axially therethrough;

a cable housing sealedly affixed within the tank mounting bore and disposed to allow a cable to move axially through the tank mounting bore;

a cable having a swaged end for connection to a hinge assembly comprising:

a frame engaging an upper surface of the toilet bowl ledge defining a downwardly extending cable run and an internal cavity including a cylindrical bearing surface having a horizontally extending axis, a hinge member supported by the bearing surface for rotation about the axis through a range of motion extending from an open hinge member position to a closed hinge member position and including a hinge pin extending outwardly of the frame, and fixedly engaged with the toilet seat to effect toilet seat rotation in common with rotation of the hinge member about the axis, the hinge member having at least one camming surface;

at least one pawl; each pawl to engage each of the at least one camming surface such that when in a first pawl position, each pawl will detain the hinge member in the open position and when in a second pawl position will allow the hinge member to rotate through the range of motion to a closed position; and rotating a bellcrank in response to the axially movement of the cable relative to the cable housing, the bellcrank being mechanically connected to the at least one pawl such that in movement from a first bellcrank position to a second bellcrank position, the bellcrank draws the at least one pawl from the first pawl position to the second pawl position; and withdrawing the at least one pawl from engagement with the camming surface in response to rotation of the bell crank thereby allowing the hinge member to rotate from the open position to the closed position.

19. The method of claim 18, whereby drawing the cable axially through the cable assembly includes rotating a flush lever having a flush lever arm, the flush lever arm being attached to the cable to draw the cable axially out of the cable housing.

20. The method of claim 18, whereby drawing the cable axially through the cable assembly includes rotating a float arm in response to a descending float supported by water in the tank assembly, the water level dropping due to an outflow of water within the tank assembly, the float arm being attached to the cable to draw the cable axially out of the cable housing.

21. A toilet closure apparatus adapted to mount on a toilet having a toilet seat, a toilet lid, and a tank assembly, the toilet closure apparatus comprising:

an activation mechanism configured to trigger a flushing event;

a tank mounting bolt having a tank mounting bore extending therethrough;

a cable housing sealingly coupled to the tank mounting bore, the cable housing extending through the tank mounting bore;

a cable coupled to the activation mechanism, the cable having a portion thereof extending through the cable housing and the tank mounting bore; and a hinge assembly rotatably coupled to the toilet lid and the toilet seat, the hinge assembly including a release mechanism operatively coupled to the cable, movement of the activation mechanism axially moving the cable through the tank mounting bore to actuate the release mechanism, actuation of the release mechanism causing at least one of the toilet seat and the toilet lid to rotate from an open position to a closed position.

22. The toilet closure apparatus of claim 21 wherein the cable is flexible so as to be maneuverable between the tank assembly and the hinge assembly.

23. The toilet closure apparatus of claim 21 wherein the activation mechanism includes a flush lever.

24. The toilet closure apparatus of claim 22 wherein the flush lever is configured to coupleably receive the cable, rotation of the flush lever axially moving the cable through the tank mounting bore.

25. The toilet closure apparatus of claim 21, further comprising:

a damper, the damper connected between a frame and a hinge member of the hinge assembly.

* * * * *

UNITED STATES PATENT AND TRADEMARK OFFICE

CERTIFICATE OF CORRECTION

PATENT NO. : 9,015,869 B2
APPLICATION NO. : 13/833511
DATED : April 28, 2015
INVENTOR(S) : Jeff Henderson It is certified that error appears in the above-identified patent and that said Letters Patent is hereby corrected as shown below:

In the Claims

Column 12, Line 35:
"rotating a bellcrank in response to the axially movement of" should read, --rotating a bellcrank in response to the axial movement of--.

Signed and Sealed this
Twenty-second Day of March, 2016

Michelle K. Lee

Michelle K. Lee
*Director of the United States Patent and Trademark Office*